US008496086B2

(12) United States Patent
Gerkinsmeyer

(10) Patent No.: US 8,496,086 B2
(45) Date of Patent: Jul. 30, 2013

(54) MEMBRANE HAVING A MULTIPART STRUCTURE

(75) Inventor: Norman Gerkinsmeyer, Neu-Ulm (DE)

(73) Assignee: Norman Gerkinsmeyer, Neu-Ulm (DE)

( * ) Notice: Subject to any disclaimer, the term of this patent is extended or adjusted under 35 U.S.C. 154(b) by 116 days.

(21) Appl. No.: 12/667,531

(22) PCT Filed: Jun. 27, 2008

(86) PCT No.: PCT/EP2008/005293

§ 371 (c)(1),
(2), (4) Date: Feb. 25, 2012

(87) PCT Pub. No.: WO2009/003658

PCT Pub. Date: Jan. 8, 2009

(65) Prior Publication Data

US 2010/0288579 A1 Nov. 18, 2010

(30) Foreign Application Priority Data

Jul. 2, 2007 (DE) ..... 10 2007 030 665

(51) Int. Cl.
*G10K 13/00* (2006.01)

(52) U.S. Cl.
USPC ..... 181/169; 381/428

(58) Field of Classification Search
USPC ..... 181/157, 164, 166, 167, 168, 169, 181/170; 381/426, 428
See application file for complete search history.

(56) References Cited

U.S. PATENT DOCUMENTS

| | | | | |
|---|---|---|---|---|
| 4,140,203 | A * | 2/1979 | Niguchi et al. | 181/167 |
| 5,206,466 | A * | 4/1993 | Inamiya | 181/169 |
| 5,274,199 | A * | 12/1993 | Uryu et al. | 181/169 |
| 6,039,145 | A * | 3/2000 | Ogura et al. | 181/167 |
| 6,404,897 | B1 * | 6/2002 | Devantier et al. | 381/426 |
| 6,453,049 | B1 * | 9/2002 | Chu et al. | 381/152 |
| 6,591,938 | B2 * | 7/2003 | Inoue et al. | 181/167 |
| 2001/0006131 | A1 * | 7/2001 | Bream | 181/167 |
| 2004/0112672 | A1 * | 6/2004 | Ono et al. | 181/169 |
| 2004/0265564 | A1 * | 12/2004 | Tokura et al. | 428/316.6 |
| 2005/0051380 | A1 * | 3/2005 | Takayama et al. | 181/170 |
| 2005/0211499 | A1 * | 9/2005 | Schwarzenberg et al. | 181/167 |
| 2006/0266577 | A1 * | 11/2006 | Inoue et al. | 181/167 |

* cited by examiner

*Primary Examiner* — Jeremy Luks
(74) *Attorney, Agent, or Firm* — David B. Dort; Dort Patent, P.C.

(57) ABSTRACT

The invention relates to a composition of a speaker membrane, consisting at minimum of the following layering sequence:
a first cover layer (3) made of a plastic,
a first adhesive layer (2), and
a first layer (4) manufactured from a non-woven material (fleece) made of fibers.

19 Claims, 4 Drawing Sheets

MEMBRANE HAVING A MULTIPART STRUCTURE

The invention relates to a very thin, deflection-resistant, light, multiple-part or multi-layer membrane, which has very high inner damping and whose properties are particularly well suited, owing to the combination of various materials and owing to the ultimate further processing by methods of varied nature, such as thermal processes, to manufacture of speaker membranes.

The material used consists in essence of at least one amorphous or crystalline foil, which is adhesively bonded via at least 1 adhesive layer with at least non-woven layer (fleece or spun yarn) into a layer sequence or sandwich structure.

As a rule, previously employed membrane technologies have a Composition that proves always to be disadvantageous in one respect.

It is the task of the invention to find a better implementation of a speaker membrane.

This problem is solved by the features of the independent patent claims. Advantageous further embodiments of the invention are the subject of the subordinate claims.

As has been shown after all by about 100 years of history and evolution of dynamic speaker technology, and has now ultimately been proven, at a wide range of frequencies the best membrane in desirable fashion has the following properties:

1. as low weight as possible
2. high deflection resistance
3. high inner damping.

Certainly for this, some already implemented Compositions and a number of patents exist. It also has been shown, however, that as a rule, all these structures have only 2 of the 3 properties to a satisfactory degree. One of the 3 properties falls by the wayside as a rule.

One example: with high deflection resistance, as a rule very thick fiber materials are used, aluminum or foam or honeycomb sandwich membranes, with great weight resulting and no inner damping, thus suited only for the bass range.

A further example: with low weight, plastic foils are used—thin fiber membranes or fabric membranes, with the result of low weight, good damping, no deflection resistance; and thus only suited for the medium to treble range.

The material presented here according to the invention or the membranes that can be made of them, have all the required features, because the materials used are combined according to their best features with other materials.

The example that now follows is only one of many possibilities for material combinations:

The amorphous or crystalline material PEEK (polyetheretherketone) is used as the outer layer or cover layer, for example. This material has the property of altering its state starting at a very high processing temperature, and then again increasing in hardness and strength with this state able to change again depending on addition of talc, for example. It should be mentioned that care should be taken that the foil or material in every case must be plasma-treated, to eliminate the surface tension and ensure better gluing or adhesion.

The outer layers are glued on, or more accurately laminated on, by means of an adhesive that can be thermoplastically shaped and also does not break down at high temperatures, or with a central layer made for example of so-called Veil (the English word for Gespinst) from long fibers such as carbon which are bound with a polyvinyl alcohol or polyester binder. This occurs at high pressure (1 to 10 bar per $m^2$) and high temperature, between 1° C. and 360° C.

It has proven to be very advantageous that care with this is to be taken that the adhesive or rather the amount of adhesive should in no instance be so great that each fiber is drenched with adhesive, and the veil in no case gets completely saturated, and thus glued into a lump.

Only as much adhesive may be used as to make it impossible for the fibers to fall apart or break, and thus for the complete membrane to be destroyed. Thus also possible interference is prevented.

By this means it is guaranteed that the high damping of carbon, for example, is not lost as such, since the fibers, owing to friction with each other that then becomes possible, dissipate the energy of motion or disturbing material-resonance plastic foils or cover layers, by incorporating them and by thermal conversion.

Owing to the fact that these sandwich membranes turn out to be very thin, depending on the cover layer, adhesive and intermediate-layer material employed, and owing to the small quantities of adhesive used, the membrane is usable in broad frequency ranges, and thus also for the treble range.

Also, multi-layer Compositions of the intermediate layer are conceivable, if, for example, a still stronger and heavier membrane is needed, here for very large membranes in the realm of professional sound systems.

Owing to the invention-specific membrane technology, in principle every development, even for very specific membrane materials and applications, is now possible.

With the example or possible version named here, after laminating, the membranes are shaped or deep-drawn by high pressure and high temperatures, between 1° C. and 450° C., between two tool halves (forms).

With this, one still can apply specific control of the strength solely through different tempering of the tool.

However, as described, this relates only to plastics such as the previously named PEEK or polyphenylene sulfide, the state of which is altered starting at certain temperatures.

Thus for example it is possible to heat the tool more in the center than at the edge. By this means, the membrane thus produced is harder or stiffer than toward the edge.

The result with a conical membrane would be: owing to the fact that with normal dynamic speakers, a central oscillation coil does the driving or the membrane is put into oscillation, at low tones, thus with large amplitudes, the membranes oscillate as a whole, forming piston shapes, and toward the higher frequencies, the outer edge of the membrane would be able to increasingly uncouple toward the center, the higher the frequency becomes.

Thus for example, one could conceive the outer edge or the center diameter or even in other geometric forms, in order to prevent certain membrane or plate modes. Thus, naturally also flat membranes are to be produced that include certain properties, for example so-called flexural resonator structures (Manger converters); speaker membranes for so-called NXT speaker structures (distributed mode speakers), speakers that operate according to the coincidence principle, or also mixed forms or hydrids of the previously described principles.

Thus it naturally is also possible to produce certain desired properties by means of the shape. Owing to a subsequent coating or painting, further properties like additional damping or color schemes, can be brought into being.

The areas of use or the possible applications, like the structure itself, are extremely multi-faceted. Hardly any limitations exist here. Speakers thus manufactured can be used in areas like homes, sound systems, installations, automobiles, aviation, marine environments etc. The locations where they are installed could be: free standing or suspended situations on or in walls, partition walls, on or in floors, beneath or in roofs, on or in doors of motor vehicles, doors, covers, panelings and fittings.

Examples of materials that can be used:

Fiber materials, which may have fibers of differing or identical length and/or thickness, such as carbon, fleece, carbon veil (an English term), fiber mats or fiber felt, with polyvinyl alcohol or polyester binders made, for example of:

aramid, polyester, polyamide, paraaramide, metaaramide, silicon carbide, silicon carbide+titanium, LCP (liquid crystal polymer), polypropylene, polyethylene filbers, PVDC, PVDF, PTFE, HD-PE, CFF fibrillated fibers, polyphenylene sulfide, polyamide, carbon and Quartzel, silica, Nextel, inox, polyaryletherketone (PAEK), a composition from an aromatic polyimide and an aromatic polyether sulfone, PEEK (polyetheretherketone), polycrystalline SIC (silicon) fibers, NICALON SiC (silicon) fibers, basalt as well as mixed fabrics or fiber semi-finished products made from the above-named materials. å

Hybrid fabrics made of fibers with polyvinyl alcohol or polyester binders such as:

HF hybrid combinations, carbon-aramid fiber combinations, polyethelene-carbon fiber combinations, polyethylene—glass fiber combinations, carbon-glass fiber combinations, aramid-glass fiber combinations Cover layers and foils also provided with additives like talc:

Polyester, polyamide, paraaramide, metaaramide, polypropylene, polyethylene, PVDC, PVDF, PTFE, HD-PE, polyphenylene sulfide, polyimide, carbon, polyaryletherketone (PAEK), Composition from an aromatic polyimide and an aromatic polyether sulfone, PEEK (polyetheretherketone), metals such as aluminum, paper and fiber materials as well as material mixtures from the materials named above.

As well as various cover layers and foils made from the previously-named materials, i.e. one side being polyester and the other side aluminum.

The combinations of features described as follows appear to be particularly favorable:

I. Composition of a speaker membrane, at minimum consisting of the following
layering sequence:
a first cover layer,
a first layer of adhesive,
a first intermediate layer produced from fibers
a second layer of adhesive and
a second cover layer.

II. Composition of a speaker membrane, at minimum consisting of the following layering sequence:
a first cover layer,
a first layer of adhesive,
a first intermediate layer produced from fibers with a first predominant direction of the fibers contained,
a second layer of adhesive,
a second intermediate layer produced from fibers with a second predominant direction of the fibers contained, with the second intermediate layer situated to be turned relative to the first intermediate layer as regards the predominant direction,
a third layer of adhesive, and
a second cover layer.

III. Composition of a speaker membrane according to one of the feature combinations I to II, with the speaker membrane during manufacture brought into a three-dimensional form by thermoplastic shaping.

IV. Composition of a speaker membrane according to one of the feature combinations I to III, with the adhesive layers only wetting the adjoining intermediate layers, without penetrating them.

V. Composition of a speaker membrane according to one of the previous feature combinations, with at least one of the intermediate layers consisting of a fabric.

VI. Composition of a speaker membrane according to one of the previous feature combinations, with at least one of the intermediate layers consisting of a fleece (non-woven material).

VII. Composition of a speaker membrane according to feature combination IV, with the at least one intermediate layer consisting of fleece having at least partial polyvinylalcohol and/or polyester binders.

VIII. Composition of a speaker membrane according to one of feature combinations II to VII, with the intermediate layers turned, preferably by 90°, to each other so that their predominant directions neutralize each other.

IX. Composition of a speaker membrane according to one or more of the previous feature combinations, with the intermediate layer consisting of veil or fleece, which has fibers made of carbon.

X. Composition of a speaker membrane according to one or more of the previous feature combinations, with the intermediate layer consisting of veil or fleece, which has fibers made of glass.

XI. Composition of a speaker membrane according to one or more of the previous feature combinations, with the intermediate layer consisting of veil or fleece, which has fibers made of aramid.

XII. Composition of a speaker membrane according to one or more of the previous feature combinations, with the intermediate layer consisting of veil or fleece, which has fibers made of polycrystalline SiC.

XIII. Composition of a speaker membrane according to one or more of the previous feature combinations, with the intermediate layer consisting of veil or fleece, which has fibers made of silicon carbide and titanium.

XIV. Composition of a speaker membrane according to one or more of the previous feature combinations, with the intermediate layer consisting of veil or fleece, which has fibers made of LCP.

XV. Composition of a speaker membrane according to one or more of the previous feature combinations, with the intermediate layer consisting of veil or fleece, which has fibers made of a mixture of the previously named materials.

XVI. Composition of a speaker membrane according to one or more of the previous feature combinations, with the intermediate layer consisting of veil or fleece, which has fibers made of a carbon fabric.

XVII. Composition of a speaker membrane according to one or more of the previous feature combinations, with the intermediate layer consisting of veil or fleece, which has fibers made of an aramid fabric.

XVIII. Composition of a speaker membrane according to one or more of the previous feature combinations, with the intermediate layer consisting of veil or fleece, which has fibers made of a glass fiber fabric.

XIX. Composition of a speaker membrane according to one or more of the previous feature combinations, with the intermediate layer consisting of veil or fleece, which has fibers made of a silicon carbide and titanium fabric.

XX. Composition of a speaker membrane according to one or more of the previous feature combinations, with the intermediate layer consisting of veil or fleece, which has fibers made of a silicon carbide fabric.

XXI. Composition of a speaker membrane according to one or more of the previous feature combinations, with the intermediate layer consisting of veil or fleece, which has fibers made of an LCP fabric.

XXII. Composition of a speaker membrane according to one or more of the previous feature combinations, with the intermediate layer consisting of veil or fleece, which has fibers made of a fabric which has fibers that are a mixture of the previously-named materials.

XXIII. Composition of a speaker membrane according to one or more of the previous feature combinations, with the cover layer consisting of a plastic.

XXIV. Composition of a speaker membrane according to one or more of the previous feature combinations, with the cover layer consisting of a plastic that also may be amorphous or crystalline.

XXV. Composition of a speaker membrane according to one or more of the previous feature combinations, with the cover layer consisting of PEEK (polyetheretherketone), which can also be amorphous or crystalline.

XXVI. Composition of a speaker membrane according to one or more of the previous feature combinations, with the cover layer consisting of a plastic like polyphenylene sulfide.

XXVII. Composition of a speaker membrane according to one or more of the previous feature combinations, with the cover layer consisting of a plastic like polyaryletherketone (PAEK).

XXVIII. Composition of a speaker membrane according to one or more of the previous feature combinations, with the cover layer consisting of a plastic like a mixture of an aromatic polyimide and an aromatic polyethersulfone.

XXIX. Composition of a speaker membrane according to one or more of the previous feature combinations, with the cover layer consisting of a plastic like polycarbonate.

XXX. Composition of a speaker membrane according to one or more of the previous feature combinations, with the composition being able to consist of only one cover layer with only one adhesive layer and an intermediate layer.

XXXI. Composition of a speaker membrane according to one or more of the previous feature combinations, with flat membranes also manufactured like so-called flexural resonator structures (Manger converters); speaker membranes for so-called NXT speaker structures (distributed mode speakers), speakers that operate according to the coincidence principle, or also mixed forms or hydrids of the previously described principles.

XXXII. Composition of a speaker membrane according to one or more of the previous feature combinations, with the membranes having cover layers that consist of differing materials.

XXXIII. Composition of a speaker membrane according to one or more of the previous feature combinations, with the cover layers consisting of metal foils.

XXXIV. Composition of a speaker membrane according to one or more of the previous feature combinations, with the cover layers also being coated or painted subsequently.

XXXV. Composition of a speaker membrane according to one or more of the previous feature combinations, with these manufactured by lamination at a pressure of 1 to 10 bar per $m^2$.

XXXVI. Composition of a speaker membrane according to one or more of the previous feature combinations, with these manufactured by lamination at a temperature between 1° C. and 360° C.

XXXVII. Composition of a speaker membrane according to one or more of the previous feature combinations, with the speaker membranes manufactured by deep drawing or stamping at temperatures between 1° C. and 450° C.

XXXVIII. Composition of a speaker membrane according to one or more of the previous feature combinations, with the speaker membranes manufactured therefrom being used for the customarily used complete frequency range of treble, middle and bass.

XXXIX. Composition of a speaker membrane according to one or more of the previous feature combinations, with the speaker membranes manufactured therefrom by tools with deliberately differing warmth during shaping or production of differing strengths, corresponding to the thermal effect over the contour or surface.

XL. Composition of a speaker membrane according to one or more of the previous feature combinations, with the adhesive used for the lamination of the individual layers having thermoplastic properties.

XLI. Composition of a speaker membrane according to one or more of the previous feature combinations, with the foils being plasma-treated, for example, for the purpose of better adhesion before lamination.

XLII. Composition of a speaker membrane according to one or more of the previous feature combinations, with the foils being treated with primer or coated, for example, for the purpose of better adhesion before lamination.

XLIII. Composition of a speaker membrane according to one or more of the previous feature combinations, with the fibers of the intermediate layer having differing lengths.

XLIV. Composition of a speaker membrane according to one or more of the previous feature combinations, with at least 50% of the fibers of the intermediate layer lying in a range of +/−10% about a median of all fiber lengths.

XLV. Composition of a speaker membrane according to one or more of the previous feature combinations, with the membrane being re-shaped immediately after shaping by another cooled tool.

In what follows, the invention is described in greater detail using the preferred embodiment example with the aid of the figures. Shown in particular are:

FIG. 1: Symmetric composition with an intermediate layer and 2 adhesive layers FIG. 2: Symmetric composition with two intermediate layers and 3 adhesive layers FIG. 3: Version of a conical membrane FIG. 4: Version of a section with a one-sided cover layer FIG. 5: Version of a section with a dual-sided cover layer FIG. 6: Version of a section with two cover layers and one intermediate layer FIG. 7: Frequency progression and distortions of a 100 mm mid-range speaker with the invention-specific membrane of standardized drive FIG. 8: Frequency progression and distortions of a 100 mm mid-range speaker with an aluminum membrane of standardized drive FIG. 9: Frequency progression and distortions of a 160 mm mid-range speaker with the invention-specific membrane of standardized drive FIG. 10: Frequency progression and distortions of a 160 mm mid-range speaker with an aluminum membrane of standardized drive FIG. 1 shows as a variant the membrane configured according to the invention with a symmetric composition. The intermediate layer of veil 4 with the adhesive layers 2 and the cover layers 3.

FIG. 2 shows as a variant the membrane configured according to the invention with a dual symmetrical composition.

With the directionally oriented intermediate layers (fleeces 5) that are turned against each other and the adhesive layers 2 and the cover layers 3.

Figure 7:
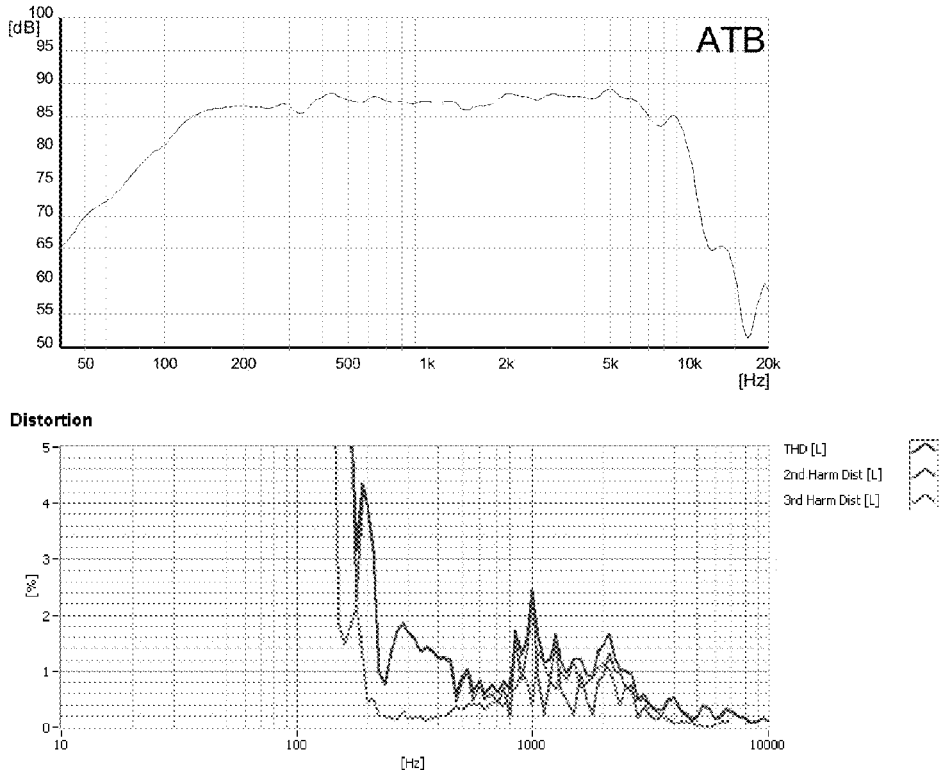
Figure 8:
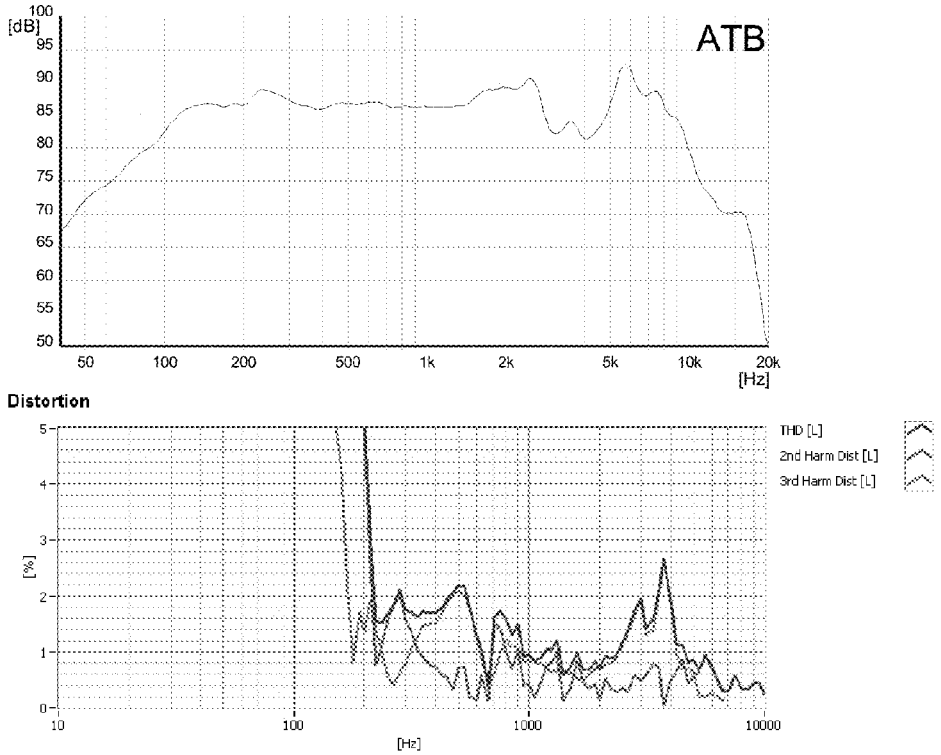

In FIG. 7 one can perceive the frequency progression and the distortion behavior (lower cluster of curves in %) of a speaker with the invention-specific membrane or technology as a 100-mm diameter system. If we compare the curves or amplitude progressions of the frequency progression and the distortions with those of FIG. 8, which is the same speaker only with an aluminum membrane, we quickly perceive that all of the curves from FIG. 7 have a linear or straight frequency progression and that the distortions are less.

Figure 9:
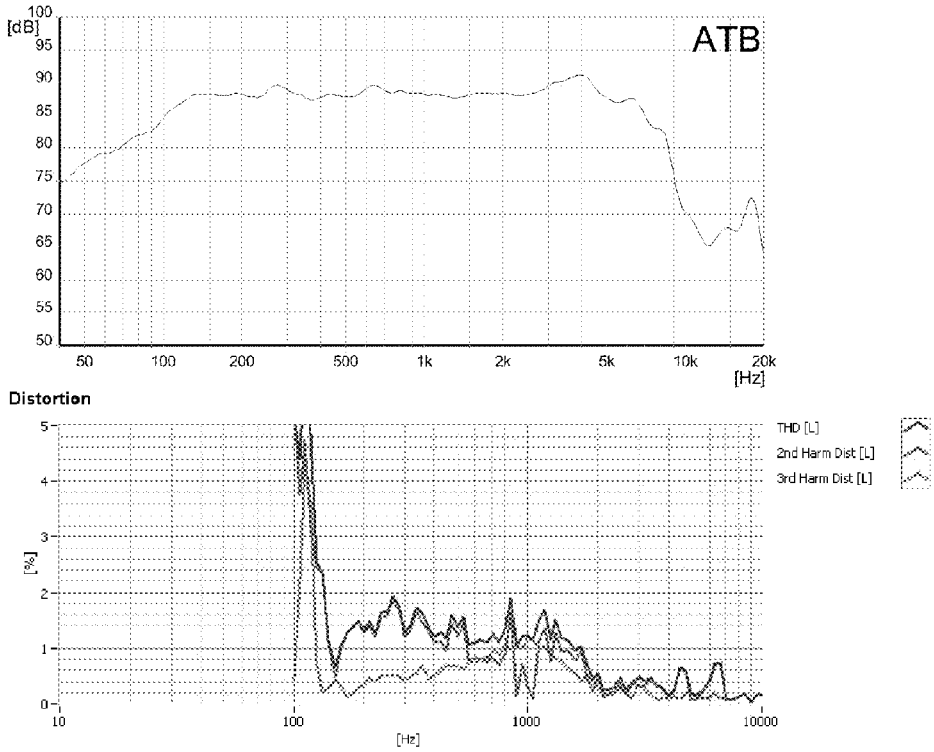
Figure 10:
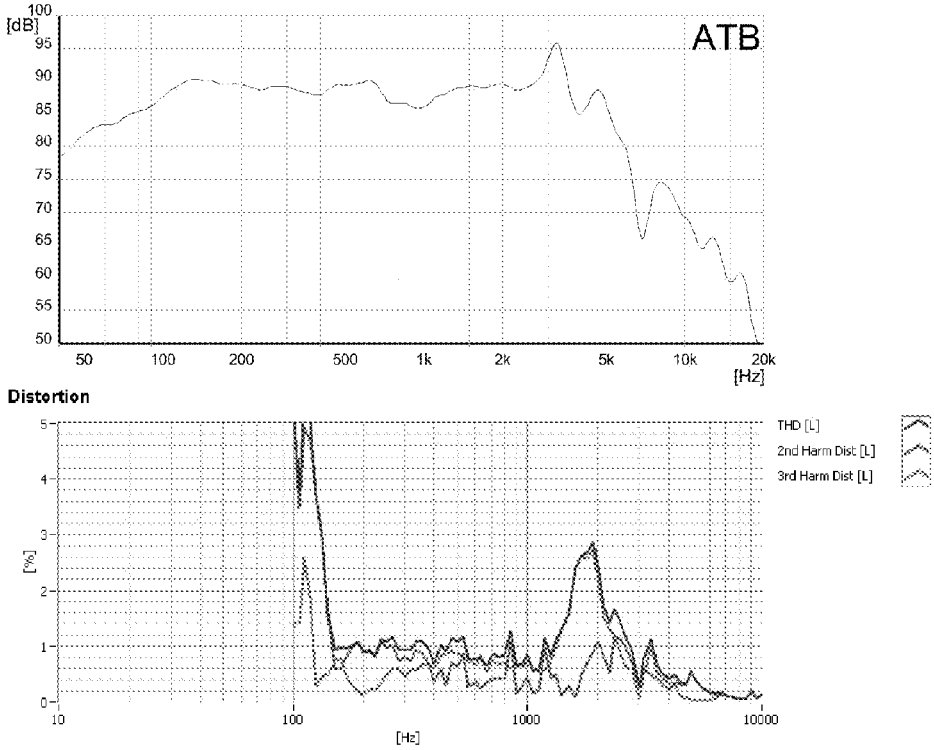

What is proven with FIGS. 9 and 10 that follow (behaving exactly like FIG. 7 in comparison to FIG. 8) is that the advantages are not only random or size-dependent, but rather completely inherent in the system, as regards the invention-specific membrane or technology—depicted in FIG. 9. In this case, speakers with diameters of 160 mm are compared. Here also all the amplitudes are better or more linear than those of the other membranes from FIG. 10, here again the same speaker but with an aluminum membrane.

Figure 1:
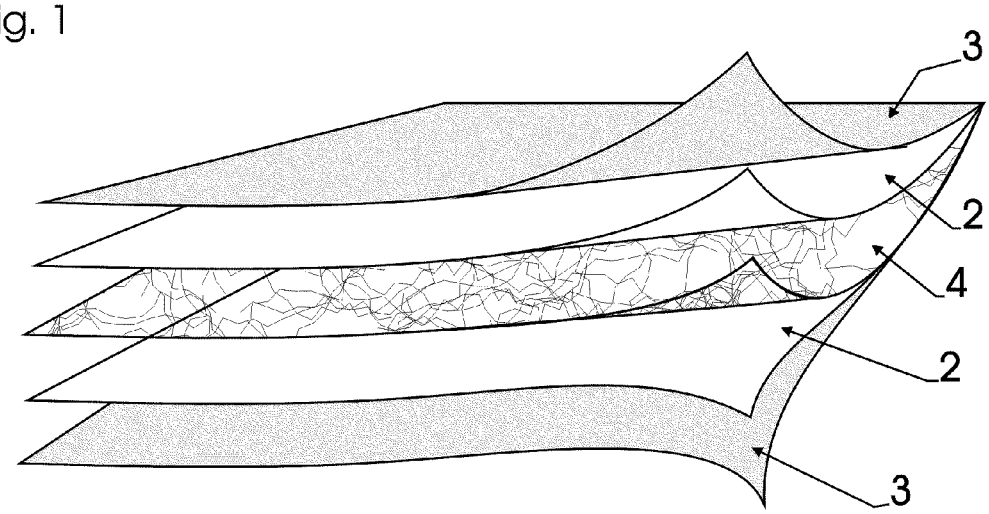

In FIG. 1, the invention-specific membrane material is depicted which—depicted from top to bottom—is glued by lamination, the cover layer in this example of PEEK (polyetheretherketone) 3, with adhesive 2 and the carbon veil 4 manufactured from non-directionally oriented fibers as well as by adhesive 2 with another cover layer in this example of PEEK (polyetheretherketone) 3 into a sandwich structure.

Figure 2:
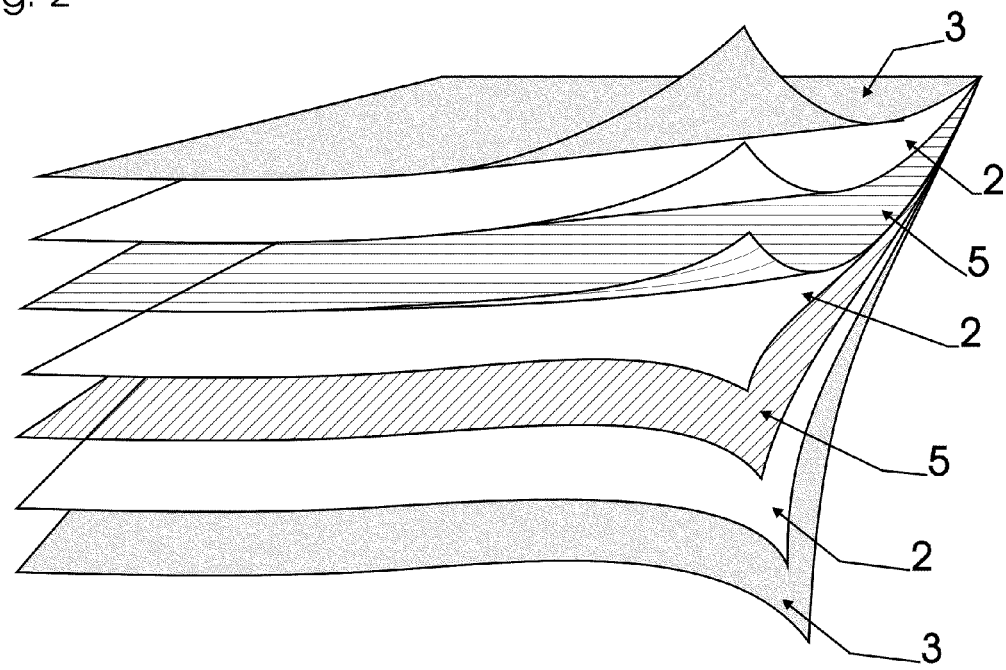

In FIG. 2, the invention-specific membrane material is depicted which—depicted from top to bottom—is glued by lamination, the cover layer in this example of PEEK (polyetheretherketone) 3, with adhesive 2 and the carbon fleece 5 manufactured from another directionally oriented fiber which is turned 90° to the previous layer 5 and by adhesive 2 with another cover layer in this example of PEEK (polyetheretherketone) 3 into a sandwich structure.

Figure 3:
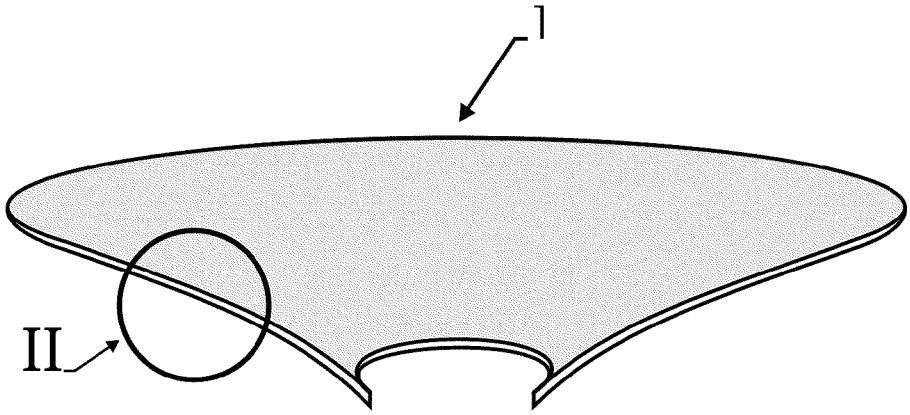
FIG. 3 shows a typical cone-shaped speaker membrane made of the membrane material configured according to the invention.

In FIG. 3, the invention-specific membrane material is depicted as described in FIG. 1, which has been deep-drawn or shaped via the previously described way and manner into a conical speaker membrane.

Figure 4:
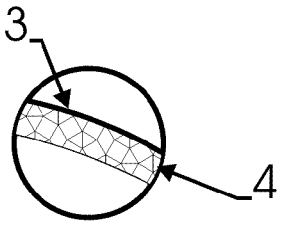
FIG. 4 shows the section of FIG. 3 in the version as a one-sided membrane structure with the cover layer and a layer of veil 4.
Figure 5:
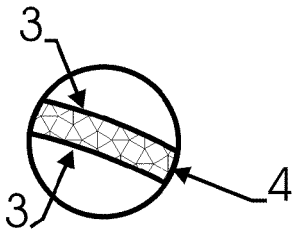
FIG. 5 shows the section of FIG. 3 in the version as a symmetrical membrane structure like FIG. 2.
Figure 6:
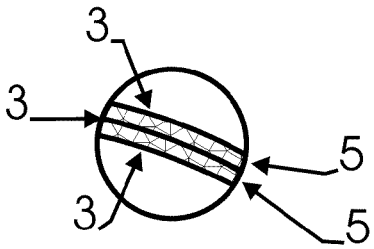
FIG. 6 shows the section of FIG. 3 in the version as a dual symmetrical membrane structure with the cover layers 3 and the intermediate layers made of directionally oriented fleeces 5, which are glued so as to be turned against each other.

FIGS. 4 to 6 show the invention-specific membrane material, which has been deep-drawn or shaped via the previously described way and manner into a conical speaker membrane in various versions.

FIG. 4 shows the invention-specific membrane material as a membrane coated on one side, consisting of a cover layer 3—in this example, PEEK (polyetheretherketone)—with the carbon veil 4 produced from non-directionally-oriented fibers, for the purpose of purely mechanical damping of cover layer 3.

FIG. 5 shows the dual-sided sandwich structure as described in FIG. 1, and FIG. 6 shows the dual sandwich structure according to FIG. 2.

The protective claims now submitted with the application and turned in later are attempts to make formulations without prejudice to achieving additional protection. The references indicated in the dependent protective claims indicate further formation of the subject of the main protective claim through the features of the particular subordinate protective claim. However, these are not to be understood as declining the attainment of an independent, objective protection for the features of the reflexive subordinate protective claims. Features that until now were only disclosed in the specification can be claimed in the course of the procedure as being of significance essential to the invention, for example for making distinctions from prior art.

The invention claimed is:

1. Speaker membrane, consisting at minimum of the following layering sequence: a first cover layer (3) made of a plastic, a first adhesive layer (2), a first intermediate layer (5) manufactured from a non-woven material of fibers, with a first predominant direction of the contained fibers, a second adhesive layer (2), a second intermediate layer (5) manufactured from a non-woven material with a second predominant direction of the contained fibers, with the second intermediate layer (5) situated so as to be turned relative to the first intermediate layer (2) as regards the predominant directions, a third adhesive layer (2) and a second cover layer (3) made of plastic.

2. Speaker membrane according to claim 1, characterized in that the adhesive layers (2) only wet the adjoining intermediate layers (5, 4) without penetrating them.

3. Speaker membrane according to claim 1, characterized in that the intermediate layers (4, 5) are turned relative to each other, preferably by 90 degrees so that their predominant directions are neutralized.

4. Speaker membrane according to claim 1, characterized in that the intermediate layer (4, 5) has at least in part fibers made of carbon.

5. Speaker membrane according to claim 1, characterized in that the cover layer (3) consists of a plastic that is amorphous or crystalline.

6. Speaker membrane according to claim 1, characterized in that the cover layer (3) consists of a plastic comprising PEEK.

7. Speaker membrane according to claim 1, characterized in that the cover layer (3) consists of a plastic comprising polyphenylene sulfide.

8. Speaker membrane according to claim 1, characterized in that the cover layer (3) consists of a plastic comprising polyaryletherketone.

9. Speaker membrane according to claim 1, characterized in that the cover layer (3) consists of a plastic comprising a mixture of an aromatic polyimide and an aromatic polyethersulfone.

10. Speaker membrane according to claim 1, characterized in that the foils are plasma-treated for better adhesion before lamination.

11. Speaker membrane according to claim 1, characterized in that the foils are treated with a primer or coated for better adhesion before lamination.

12. Speaker membrane according to claim 1, characterized in that the fibers of the intermediate layer (4, 5) are configured to be of differing lengths.

13. Speaker membrane according to claim 1, characterized in that the fibers of the intermediate layer (4, 5) are configured to be of differing lengths.

14. Speaker membrane according to claim 1, characterized in that the fibers of the intermediate layer (4, 5) are configured to be of differing lengths.

15. Speaker membrane according to claim 1, characterized in that the intermediate layer (4, 5) has at least in part fibers made of carbon.

16. Speaker membrane according to claim 1, characterized in that the cover layer (3) consists of a plastic that is amorphous or crystalline.

17. Speaker membrane according to claim 1, characterized in that the cover layer (3) consists of a plastic comprising PEEK.

18. Speaker membrane according to claim 1, wherein said non-woven material is fleece.

19. Speaker membrane according to claim 1, characterized in that the at least one intermediate layer (4, 5) has in part at least one of polyvinyl alcohol and polyester binders.

* * * * *